US005094294A

United States Patent [19]

Bayh, III

[11] Patent Number: 5,094,294

[45] Date of Patent: Mar. 10, 1992

[54] WELL PUMP ASSEMBLY AND PACKER

[75] Inventor: Russell I. Bayh, III, Carrollton, Tex.

[73] Assignee: Otis Engineering Corp., Dallas, Tex.

[21] Appl. No.: 32,470

[22] Filed: Mar. 30, 1987

[51] Int. Cl.[5] ..... E21B 33/129

[52] U.S. Cl. ..... 166/106; 166/120; 166/188; 166/319

[58] Field of Search ..... 166/106, 118, 120, 126, 166/133, 142, 188, 189, 319, 105

[56] References Cited

U.S. PATENT DOCUMENTS

| | | | |
|---|---|---|---|
| 3,326,292 | 6/1967 | Young et al. | 166/106 |
| 3,381,752 | 5/1968 | Elliston | 166/189 |
| 3,921,720 | 11/1975 | Wetzel | 166/187 |
| 4,008,759 | 2/1977 | Blackwell | 166/242 |
| 4,190,107 | 2/1980 | Oden et al. | 166/120 |
| 4,354,554 | 10/1982 | Calhoun et al. | 166/106 |
| 4,576,236 | 3/1986 | Stout | 166/125 |
| 4,582,135 | 4/1986 | Akkerman | 166/125 |
| 4,586,567 | 5/1986 | Jameson | 166/133 |
| 4,621,689 | 11/1986 | Brookbank, III | 166/106 |
| 4,625,798 | 12/1986 | Bayh, III | 166/106 |
| 4,632,184 | 12/1986 | Renfroe, Jr. et al. | 166/106 |
| 4,646,829 | 3/1987 | Barrington et al. | 16/135 |
| 4,671,361 | 6/1987 | Bolin | 166/144 |
| 4,688,634 | 8/1987 | Lustig et al. | 166/120 |

*Primary Examiner*—Terry Lee Melius
*Attorney, Agent, or Firm*—M. H. Gay

[57] ABSTRACT

A well pump assembly suspended by a cable from the surface. The assembly includes a subsurface safety valve and a packer. The packer is hydraulically set and released.

10 Claims, 6 Drawing Sheets

WELL PUMP ASSEMBLY AND PACKER

This invention relates to well equipment and in particular to a packer which may be hydraulically released and to a well pump assembly including a packer which may be hydraulically released.

This invention is an improvement over the inventions disclosed in U.S. application Ser. No. 06/913,106 filed Sept. 29, 1986 by Russell I. Bayh, III.

Packers and packers for well pump assemblies have been set and released in many different ways; see for instance U.S. Pat. Nos. 3,853,430 and 4,121,659. Prior release techniques included pulling tubing to shear pins, unscrewing threads, cutting subs with jet streams or explosives, and shifting tools to release a collet. Use of a collet in association with a packer is shown in U.S. Pat. No. 3,326,292.

In a pump assembly such as shown in the above identified application it would be preferable to be able to use a positively power set packer such as the RDH Packer available from Otis Engineering Corporation, Dallas, Tex. The packer should be provided with a means within the packer for releasing the packer as the forces needed for release are substantial and it is desirable not to exert such forces through the supporting cable.

It is an object of this invention to provide a well pump assembly in which the packer of the assembly may be released hydraulically.

Another object is to provide a well pump assembly in which the entire assembly may be run in a casing on a cable and set and locked in place and then released and recovered without benefit of a landing nipple to permit the assembly to be set at any desired depth.

Another object is to provide a well pump assembly in which the packer may be released hydraulically and preferably set hydraulically.

Another object is to provide a packer which may be released by hydraulic pressure and preferably set hydraulically.

Another object is to provide a well pump assembly and a packer which may be set and released by hydraulic pressure from a single or a dual control line.

Another object is to provide a well pump assembly where a single or a dual control line may be utilized to set and release a well packer and to operate a subsurface safety valve.

Another object is to provide a well pump assembly and a packer therefore in which the packer may be set by a control line and released by hydraulic pressure from a different control line.

Other objects, features and advantages of the invention will be apparent from the drawings, the specification and the claims.

In the drawings wherein like referenced numerals indicate like parts and wherein an illustrative embodiment of this invention is shown:

Figure 1:
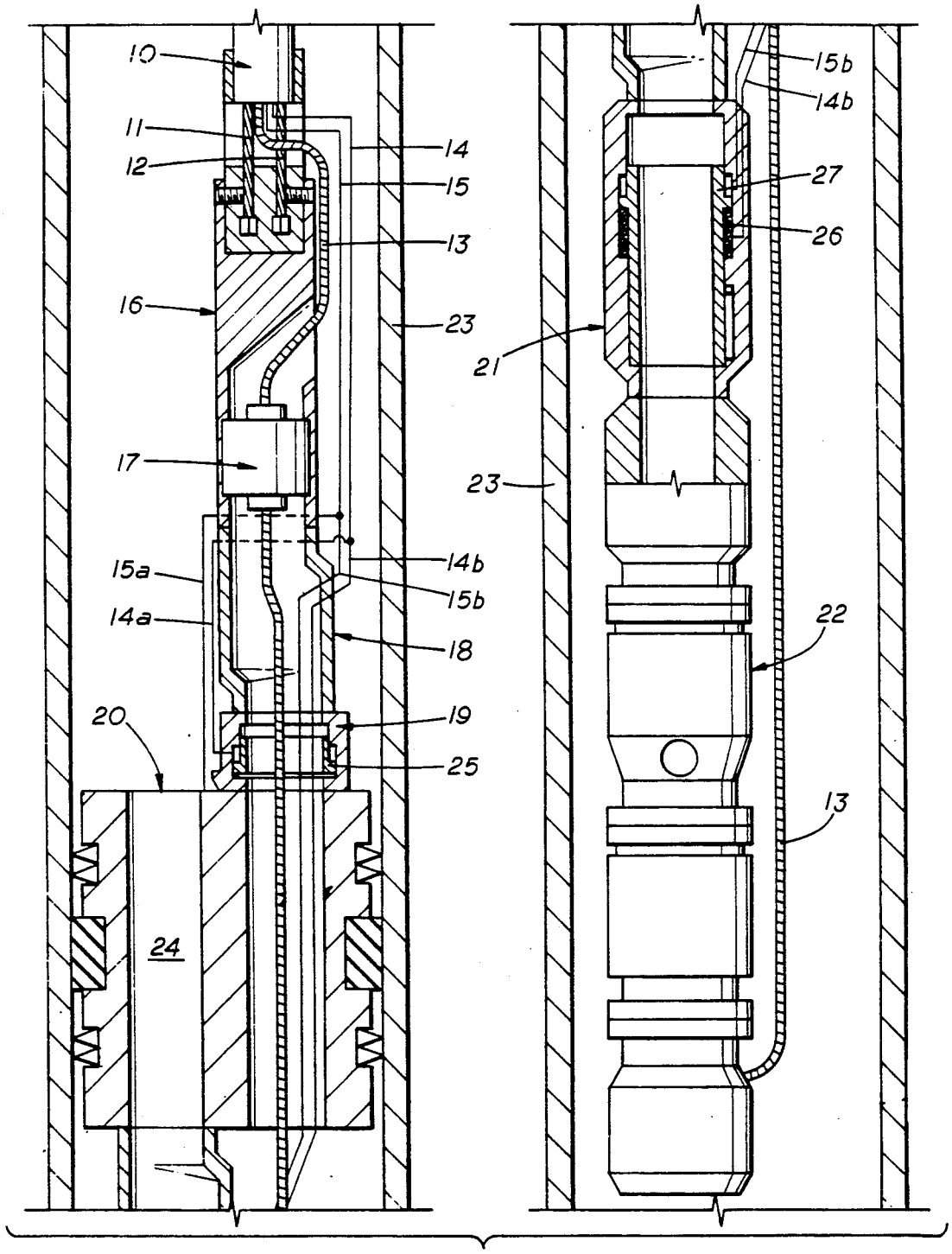
FIG. 1 is a schematic view partly in section and partly in elevation of a well pump system and packer constructed in accordance with this invention with the right hand view being a continuation of the left hand view.

Referring to FIG. 1 the well pump assembly is suspended from the surface by the cable indicated generally at 10. The cable 10 includes flexible metal wire supports 11 and 12 as well as power cable 13 and control conduit means which may include one or more conduits such as conduits 14 and 15.

The penetrator sub indicated generally at 16 is suspended from the cable and includes the penetrator indicated generally at 17 which passes the power cable 13 through the sub 16 and seals the cable to the sub.

Below the penetrator sub 16 the offset sub indicated generally at 18 supports the packer release indicated generally at 19 which in turn supports the packer indicated generally at 20.

The packer 20 in turn supports the subsurface safety valve indicated generally at 21 and the well pump indicated generally at 22 depending from the valve completes the assembly.

In accordance with this invention the packer 20 may be set in any desired manner which will permit it to carry out its function of sealing the annulus between the casing 23 and the assembly so that fluid raised by the pump 22 will pass through the bore 24 in the packer and be lifted to the surface. For instance this packer might be set by hydraulic means as will be more fully explained herein below or perhaps by the use of explosives set off by activating a control conduit as will be understood by those skilled in the art. If the hydraulic set packer is utilized the control conduit 15 will be a hydraulic conduit and a leg **15*a*** off this conduit may extend to the packer to provide hydraulic fluid for carrying out the setting operation such as in the packer disclosed in FIG. 2.

The packer may be released by activating a control conduit which in accordance with this invention is a hydraulic conduit such as conduit 14 having a branch **14*a* conducting fluid to a fluid piston 25** which is shifted to release a set packer.

Further in accordance with this invention fluid from a hydraulic conduit may be utilized to operate the subsurface safety valve 21. For instance where two control conduits are utilized and each is hydraulic, the conduit 14 may have a leg **14*b* passing through the wall of sub 18 and extending downwardly which may conduct fluid to a balance chamber 26 in the subsurface safety valve 21. This will balance the hydrostatic head of fluid in the control conduit 15. The conduit leg 15*b* extends through the wall of sub 18 and is in fluid communication with the piston 27** of the subsurface safety valve to control operation of valve. The use of such a balance chamber and control conduit is well known to those skilled in the art.

After the packer has been set, the design maybe such that the control fluid has no effect on the packer and the line 15 may be utilized to control other functions without any effect on the packer, such as controlling the subsurface safety valve through line **15*b*. Devices are also known for shutting off the flow of fluid through a conduit such as conduit 15*a* after a function has been completed. Such a device could be utilized to permit the setting of the packer 20 and then closing off the line 15*b* to permit conduit 15 to be used for other purposes such as operating the subsurface safety valve. It is further apparent that if the release piston 25 is held against reciprocation when the pressure in branch line 14*a* is less than a selected amount that a single hydraulic line could be utilized to operate the subsurface safety valve below the selected value and then operate the piston 25 to release the packer by raising the pressure to exceed the selected value. Thus it is apparent that even a single hydraulic control line could be utilized to set the packer 20** and after the packer is set to operate the subsurface safety valve and when desired raise the pressure above a selected value to operate the packer release.

Figure 2A:
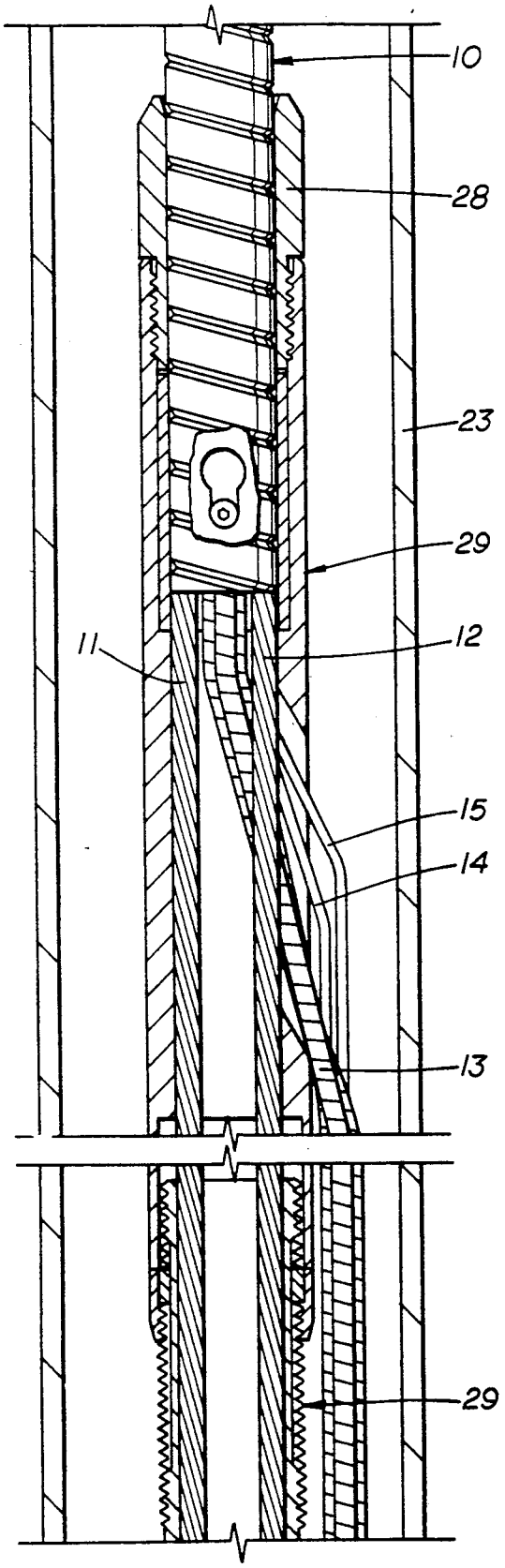
FIGS. 2A through 2J are views partly in elevation and partly in section with parts broken away illustrating a well pump system and packer constructed in accordance with this invention.
Figure 2B:
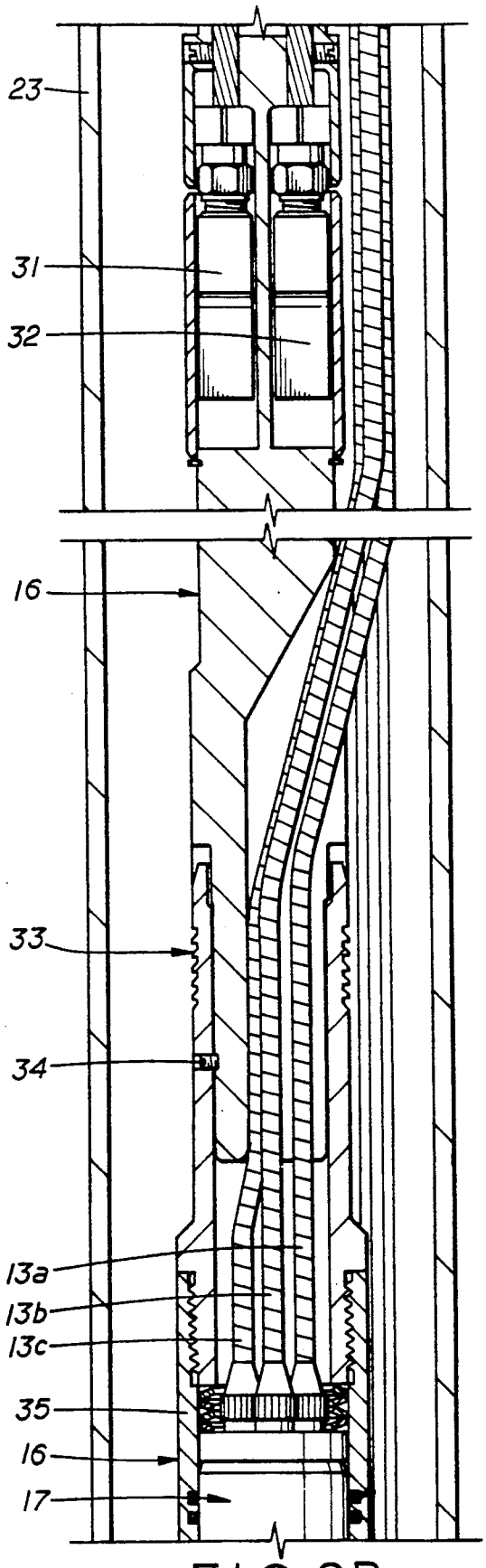
Figure 2C:
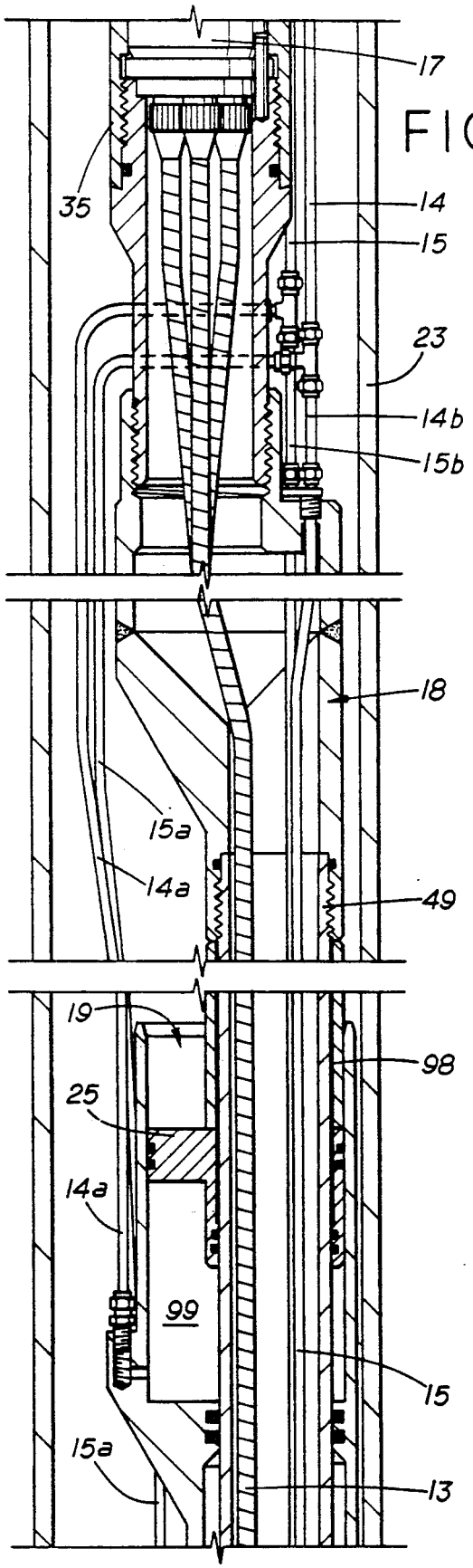
Figure 2D:
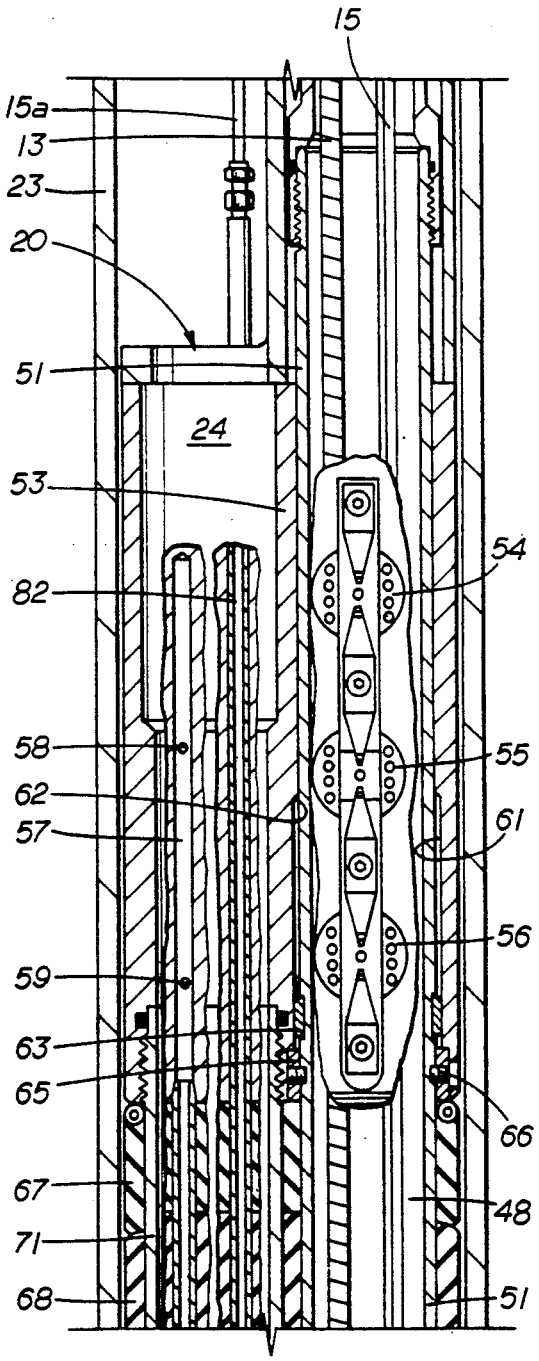
Figure 2E:
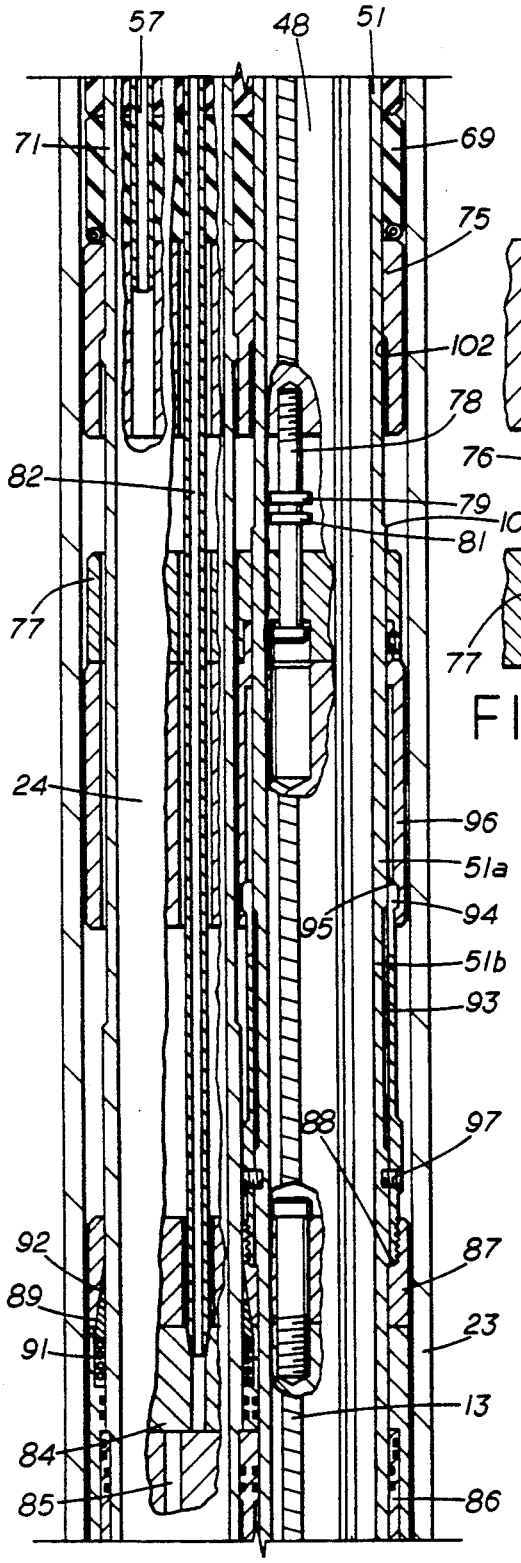
Figure 3:
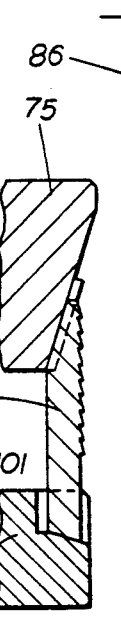
FIG. 3 is a fragmentary sectional view of the slip carrier, slips and expander cone of the packer shown in FIG. 2E.

Reference is now made to FIGS. 2 and 3 wherein a preferred form of apparatus is illustrated. In FIG. 2A the cable 10 which is suspended from the surface is shown to be received in an upper sub 28 which is connected to a space-out sleeve system indicated generally at 29. This system forms a part of the equipment for suspending the assembly from the cable as shown in the upper section of FIG. 2B. The suspension includes the drum sockets 31 and 32 fixed to the end of the cables 11 and 12 from which the two piece penetrator sub 16 is suspended. This sub also has provisions for shear out provided by a telescoping joint indicated generally at 33 and a plurality of shear pins 34. In the event the tool becomes lodged in the hole a sufficient pull on cable 10 will shear pins 34 and permit the cable to be retrieved in the conventional manner.

At the lower end of the penetrator sub 16 the penetrator 17 is provided in sealed relationship with the penetrator housing 35 and sealingly passes the three power cables 13*a, b* and *c* through the penetrator. For a detailed discussion of the construction of the equipment shown in FIGS. 2A and 2B references made to my co-opening U.S. patent application Ser. No. 913,106.

The well pump 22 (FIGS. 2I and 2J) receives power from the power system 13 and lifts the fluid in the well. Any desired well pump driven by any desired power source may be utilized as will be understood by those skilled in the art.

Figure 2F:
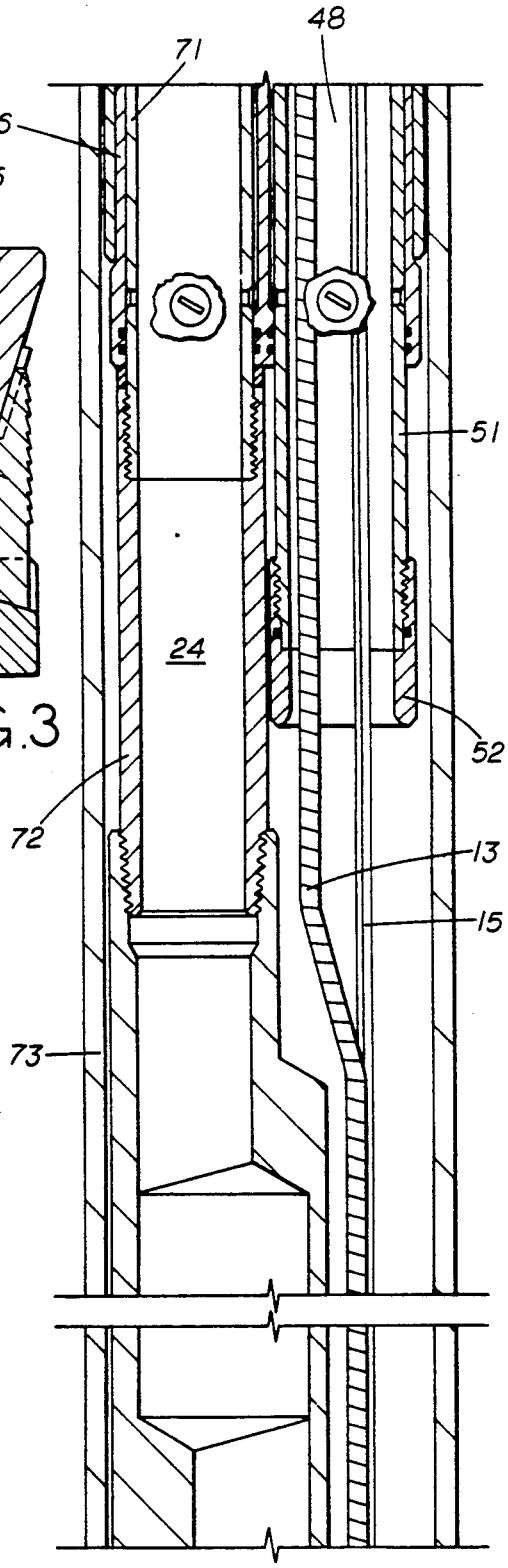
Figure 2G:
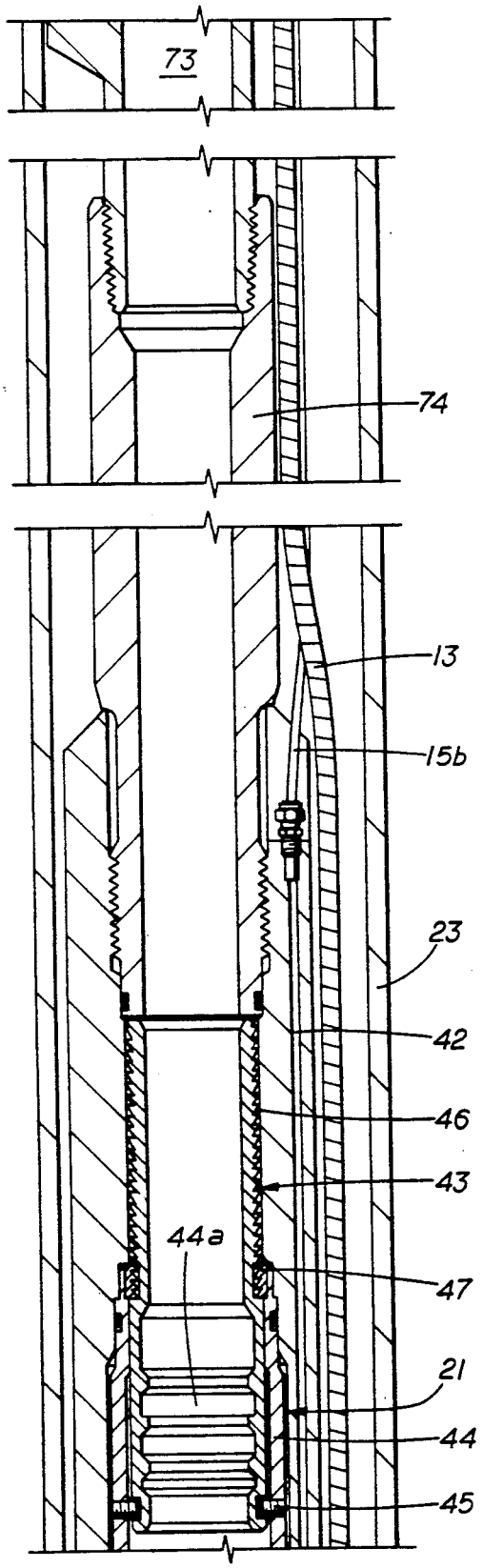
Figure 2H:
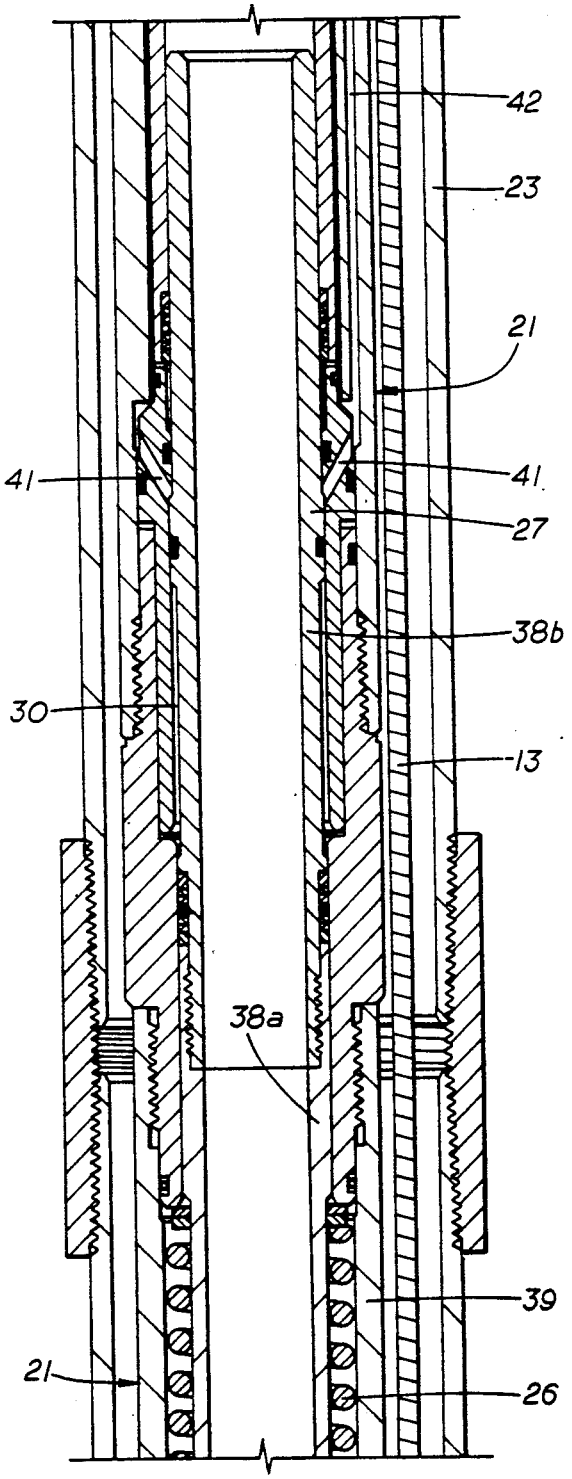
Figure 2I:
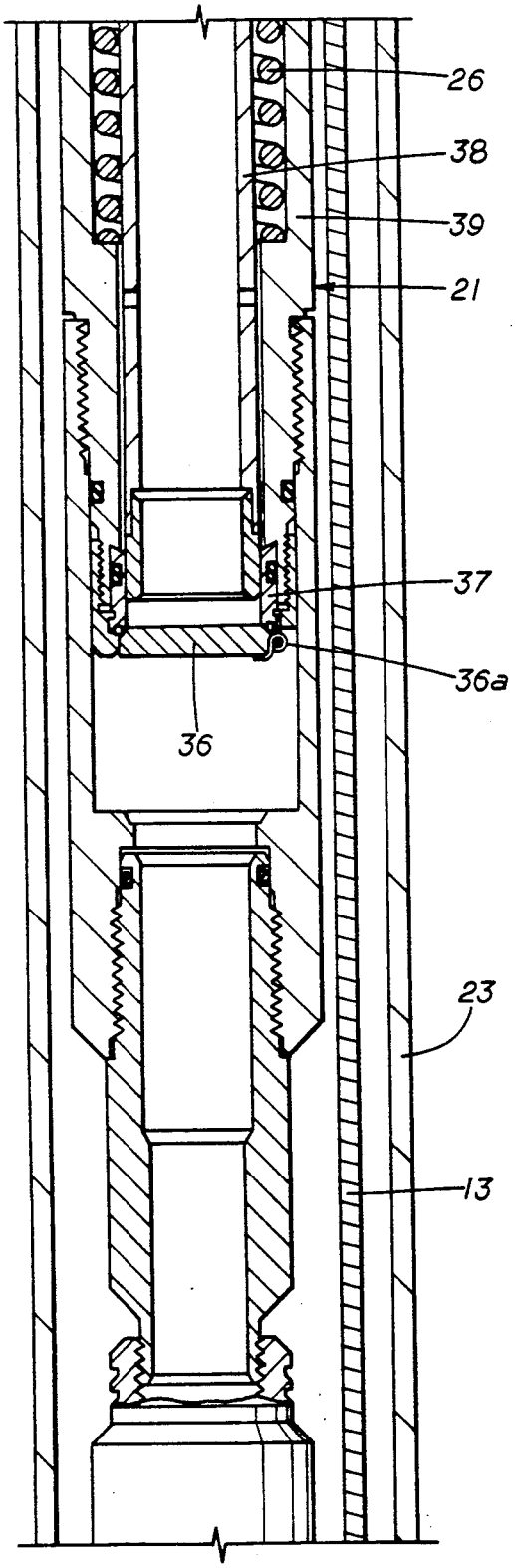
Figure 2J:
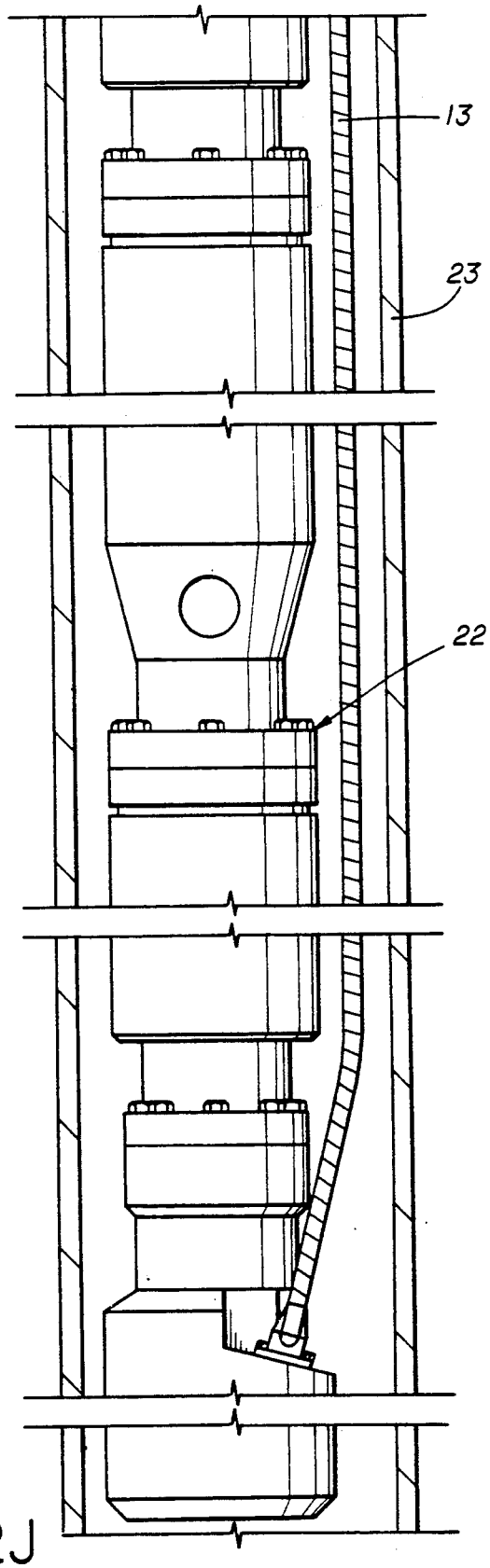

The subsurface safety valve shown in FIGS. 2G, H and I may also be any desired form of safety valve as will be understood by those skilled in the art. The illustrated valve 21 employs a flapper 36 with a seat 37 to control flow. The flapper is in turn controlled by the actuator 38 which is reciprocal within the valve body 39. The spring 36 is effective on the enlarged diameter section 38*a* of the actuator to urge the actuator upwardly. The actuator includes an upper section 38*b* which carries the piston 27 responsive to control fluid from control line 15 through port 41 which is connected with the fluid bore 42 receiving control fluid from line 15B (FIG. 2G). In the conventional manner an increase in fluid pressure in line 15*b* moves the piston 27 downwardly to open the flapper with downward movement of the actuator. On upward movement of the actuator the flapper is moved to closed position in the conventional manner by spring 36*a*.

At the upper end of the subsurface safety valve a lock out system indicated generally at 43 is provided. The sleeve 44 is provided with conventional grooves 44*a* to receive keys of a shifting tool. Upon downward movement of such shifting tool the pins 45 are sheared and the sleeve 44 moved downwardly to move the actuator 38 to its down position locking the flapper valve 36 in open position. The upper end of the sleeve 44 is provided with teeth 46 which are ratcheted down past an expansible lock ring 47 which prevent the sleeve 44 from returning to its upward position shown in FIG. 2G when the shifting tool is removed from the sleeve thus leaving the subsurface safety valve locked in open position.

Reference is now made to FIGS. 2C through 2F and to FIG. 3 wherein a preferred form of packer and packer release system is shown. The packer is preferably a modified form of a commercially available RDH packer identified above. The packer is what is known as a dual packer with the flow way 24 utilized for flow of fluid through the packer and the other bore 48 through the packer utilized to pass the power cables 13 and control conduit 15 and if desired control conduit 14 down to the safety valve. In the safety valve illustrated in FIG. 2 balance pressure is not utilized as in the case of the safety valve shown schematically in FIG. 1. If a balance fluid for the safety valve is desired the conduit would extend downwardly through the packer as shown in FIG. 1 and introduce pressure into the chamber 30 in the conventional manner.

The packer includes release mandrel means provided by upper tube 49 having depending there from the lower tube 51. On the lower end of the release mandrel an entry guide 52 is provided for the cables and control lines.

At the upper end of the packer a button housing 53 (FIG. 2D) is carried on the release mandrel and carries a plurality of button slips 54, 55 and 56 which function in the conventional manor to engage the casing 23 and limit upward movement of the packer. These button slips receive fluid from below the packer through the flow tube 57 and passages 58 and 59 between the tube 57 and the button slips in the conventional manor. Thus when the packer is set and the subsurface safety valve closed a buildup in pressure below the packer will be effected on the button slips to urge them into contact with the casing wall and prevent upward movement of the packer.

Below the button slip housing a plurality of expansible packer elements 67, 68 and 69 are provided for expansion into contact with the casing wall to seal between the packer and the casing wall.

The button slip carrier 53 also is provided with the enlarged diameter section 61 and downwardly facing shoulder 62. This shoulder is engaged by snap ring 63 when the release mandrel 51 is moved upwardly during release of the packer to remove the expanding force from elements 67, 68 and 69. The button slip housing is supported on the control mandrel by a support ring 65 releasably fastened to the support mandrel by shear pins 66.

Depending from the button slip carrier 53 is a support mandrel 71 the bore of which provides a portion of the flow way 24. A connector sub 72 (FIG. 2F) depends from the support mandrel and connects the support mandrel to the offset sub 73 which is connected to the subsurface safety valve 21 by the connector sub 74.

Slidable on the two mandrels 51 and 71 is the slip cone 75 shown in FIGS. 2E and 3. This cone cooperates with slips 76 supported on the slip carrier 77. The cone 75 and slip carrier 77 are secured together by bolt means 78 having a pair of spacers 79 and 81 between the bowl and carrier. These spacers limit movement of the bowl and carrier toward each other and thus limit the outward extent of movement of the slips 76 so that they will be retained by the slip carrier 77 and not lost in the well in the event of a malfunction. The cone, carrier and slips are well known in the art and their relationship and operation as well as the operation of the button slips 54 are shown in U.S. Pat. No. 3,381,752. The construction of the cone, slips and carrier may follow the teaching of this patent.

Means are provided for setting the packer. In the preferred form this means is hydraulic as illustrated in FIG. 2. For this purpose hydraulic fluid from the control conduit 15*a* is connected in the button slip carrier to a flow tube 82 (FIG. 2D) which is threadably connected to lower latch block 84.

The flow way 85 which communicates with flow tube 82 leads to a relief fitting to prevent excess pressure from being applied to the system. Such relief may or may not be employed as desired.

Pressure fluid from the control conduit is exerted downwardly on piston 86 to drive this piston in a downward direction. The reactive upward force is transmitted from the lower latch block 84 to the upper latch block 87 which is shouldered against the actuator mandrel 51 at 88 (FIG. 2E). The lower end of the piston 86 abuts the connector 72 (FIG. 2F) and thus downward movement of the piston 86 moves the mandrel 71 and the button slip carrier 53 (FIG. 2D) downwardly in the conventional manner. This downward movement causes the slip cone 75 (FIG. 2E) to expand the slips 76 into engagement with the casing wall to hang the packer on the casing. The downward movement also expands the packer elements 67, 68 and 69 into engagement with the casing wall to seal between the packer and the casing.

As the mandrel 71 moves downwardly it slides through the retainer slips 89 (FIG. 2E) which are urged upwardly by spring 91 into engagement with the slip bowl 92. The slips 89 lock the mandrel 71 in its down position and hold the slips 76 extended and the packer elements 67, 68 and 69 expanded for normal operation.

As the button slip carrier 53 begins its downward movement it shears the pins 66 (FIG. 2D) to permit to such downward movement. Prior to setting of the packer the shear pins 66 hold the assembly in its non-set position and prevent any downward force being applied to the slip expander 75.

In accordance with this invention when it is desired to retrieve the assembly the packer is released in response to an increase in hydraulic fluid pressure in the control line 14*a*.

The means for releasing the packer means from set position preferably includes a releasable latch means in the assembly holding the slips in the set position and a hydraulic means for releasing the latch means to permit relative movement of the slips and slip cone to release them from set position. It is further preferred that a part of the assembly be a two piece sleeve which holds the slips and slip bowl in set position together with a latch which when released, releases the two piece sleeve permitting it to collapse thus permitting the release of the slips.

In accordance with this invention in its preferred form, the upper latch block 87 (FIG. 2E) has extending upwardly there from and threaded thereto a collet 93 having its collet finger enlargements or dogs 94 held within grooves 95 in a sleeve 96. The sleeve 96 depends from and supports the slip carrier 77. With the packer in running or in the set position an enlarged diameter section 51*a* of the mandrel 51 is positioned behind the dogs 94 on the collet fingers to prop them out and hold them within the groove 95 on sleeve 96. Thus there is provided a two piece or telescoping sleeve in the form of the collet 93 and the sleeve 96 which holds the slip carrier in space relationship relative to the latch block 87 prior to the packer being released.

In accordance with this invention the preferred form of packer is released by a hydraulic means such as piston 25 which when raised under control fluid pressure carries with it the release mandrel 51 to move the enlarged mandrel section 51*a* from behind the dogs 94 on the collets. The reduced diameter section 51*b* of the release mandrel then resides behind the collet dogs 94 and these dogs may release from the groove 95.

Prior to release of the packer slips 76 the valve 21 should be opened to equalize pressure across the packer to release the button slips 54, 55 and 56.

To prevent premature release of the collet dogs the release mandrel is secured to the collet by a plurality of shear pins 97. As discussed hereinabove the value of the shear pins may be selected not only to provide the function of preventing premature release but they may be related to the value of pressure needed to operate the subsurface safety valve or to set the packer or both, such that the packer may first be set, then the subsurface safety valve may be operated, and then the packer released by shearing of these pins.

To provide for upward movement of the release mandrel 51 the piston 25 (FIG. 2C) bears against a spacer 98 which in turn bears against the lower end of the offset sub 18 from which the release mandrel depends. Thus, when pressure is applied through line 14*a* to pressurize the chamber 99 below piston 25, the piston is raised and carries with it the release mandrel 51. This results in shearing of the pins 97. After these pins are sheared the release mandrel is moved upward by cable 10 to a position where the smaller diameter section 51*b* lies behind the collet finger enlargements or dogs 94 permitting them to release from the sleeve 96.

The cable is preferably in tension when pins 97 are released. The stretched will contract to release the collet and to drive ring 63 shoulder 62 to release the setting force on the packer elements. Also as the release mandrel moves upward a shoulder 101 on the release mandrel will engage a downwardly facing shoulder 102 (FIG. 2E) to drive the slip cone 75 from behind slips 76 to release the packer. By maintaining the cable in tension during the release cycle a jar action is applied to the slip cone to jar it loose from the slips.

By providing for the hydraulic release of the shear pins 97 the cable 10 is protected against the high load that would be required to release the packer by pulling on the cable. Thus the cable may be maintained in tension during use of the assembly to prevent damage to the cable. This tension may be utilized to assist in releasing the packer.

If the packer is not completely released by the jar action discussed above, the packer will be released as the cable 10 is reeled in at the surface to raise the assembly.

The foregoing disclosure and description of the invention are illustrative and explanatory thereof and various changes in the size, shape and materials, as well as in the details of the illustrated construction, and various changes in the process, may be made within the scope of the appended claims without departing from the spirit of the invention.

What is claimed is:

1. Well pump assembly including a packer comprising:

cable means including power line means and control line means including hydraulic control line means;

well pump means suspended from said cable means and controlled by said power line means; and packer means suspended from said cable means and having a flowaway connected to and conducting fluid pumped by said pump means through said packer means;

said packer means including;

means for setting said packer means, and hydraulic means in fluid communication with said hydraulic control line means for releasing said packer means from set position.

2. The well pump assembly of claim 1 wherein subsurface safety valve means is suspended from said cable means and controls flow through said packer means and is in fluid communication with said control line means for controlling operation of said sub surface safety valve means.

3. The well pump assembly of claim 1 wherein said packer means includes release mandrel means and cooperative slips and slip cone, latch means holding said slips and slip cone in set relationship, and said hydraulic means includes piston means for moving said release mandrel means, said release mandrel means releasing said latch means in response to movement of said piston means.

4. The well pump assembly of claim 3 wherein said latch means is a collet releasably held in propped out position by said release mandrel means.

5. A packer comprising, release mandrel means, expansible packer seal element means carried by said release mandrel means for sealing with a well pipe, cooperable slips and slip cone means carried by the release mandrel means for releasably anchoring the packer in a well pipe, means including releasable latch means carried by the release mandrel means for moving said slips and slip cone means relative to each other to set position and locking them in said position, said latch means when released permitting relative movement of said slips and slip cone means to release them from set position, and hydraulic means for releasing said latch means by shifting said release mandrel.

6. A packer comprising, release mandrel means, expansible packer seal element means carried by said release mandrel means for sealing with a well pipe, cooperable slips and slip cone means carried by the release mandrel means for releasably anchoring the packer in a well pipe, hydraulic means for moving said slips and slip cone means relative to each other to set position and locking them in set position including releasably latch means carried by the release mandrel means, said releasable latch means including a two piece telescoping sleeve releasably latched in extended position, said releasable latch means released in response to movement of said release mandrel means, and piston means carried by the release mandrel means responsive to hydraulic pressure for moving said release mandrel means to release said latch means.

7. The packer of claim 6 wherein the two piece telescoping sleeve is a collet held in propped out position by said release mandrel means until movement of said release mandrel means by said piston means.

8. Well pump assembly comprising:

cable means including power line means and control line means including first and second hydraulic control line means;

well pump means suspended from said cable means and controlled by said power line means;

packer means suspended from said cable means and having a flowaway connected to and conducting fluid pumped by said pump means through said packer means;

said packer means including;

hydraulic means including a first piston receiving setting fluid from said first control line means for setting said packer, and hydraulic means including a second piston receiving setting fluid from said second control line means for releasing said packer from set position.

9. A packer comprising, release mandrel means, expansible packer seal element means carried by said release mandrel means for sealing with a well pipe, cooperable slips and slipcone means carried by the release mandrel means for releasably anchoring the packer in a well pipe, means including a first hydraulic fluid conduit and a first piston receiving fluid from said conduit and releasable latch means carried by the release mandrel means for moving said slips and slip cone relative to each other to set position and locking them in said position, said latch means when released permitting relative movement of said slips and slip cone to release them from set position, and hydraulic means including a second hydraulic fluid conduit and a second piston receiving fluid from said second conduit for releasing said latch means by shifting said release mandrel in response to pressure in said second conduit.

10. The method of producing a petroleum well comprising:

running a packer and pump on a cable having power means and hydraulic conduit means to a selected depth in a well, applying hydraulic fluid pressure through the hydraulic conduit means to set the packer, operating the pump with power applied through the cable power means to produce the well, and thereafter applying hydraulic fluid pressure through the hydraulic conduit means to release the packer.

* * * * *